United States Patent [19]

Bajulaz

[11] Patent Number: 4,513,568

[45] Date of Patent: Apr. 30, 1985

[54] METHOD FOR THE TRANSFORMATION OF THERMAL ENERGY INTO MECHANICAL ENERGY BY MEANS OF A COMBUSTION ENGINE AS WELL AS THIS NEW ENGINE

[76] Inventor: Roger Bajulaz, 825 Las Palmas Dr., Hope Ranch, Santa Barbara, Calif. 93110

[21] Appl. No.: 442,799

[22] Filed: Nov. 18, 1982

[30] Foreign Application Priority Data

Sep. 24, 1982 [CH] Switzerland ..... 5648/82

[51] Int. Cl.[3] ..... F02G 1/00

[52] U.S. Cl. ..... 60/39.6; 60/712

[58] Field of Search ..... 60/712, 39.6, 39.63; 123/204, 221, 228, 22

[56] References Cited

U.S. PATENT DOCUMENTS 4,369,623 1/1983 Johnson ..... 60/39.6

FOREIGN PATENT DOCUMENTS 448649 5/1948 Canada ..... 60/39.6

*Primary Examiner*—Stephen F. Husar

*Attorney, Agent, or Firm*—Young & Thompson

[57] ABSTRACT

An energy transformation cycle in which the number of strokes is higher than four, at least four of which are:

a. the compression of air contained in a variable volume chamber, into a preheating chamber;

b. the expansion of the variable volume chamber through the expansion of hot air contained in the preheating chamber;

c. the compression of the expanded hot air contained in the variable volume chamber into a combustion chamber where fuel is introduced to cause the combustion of the mixture; and d. the expansion of the variable volume chamber through the expansion in the chamber of high temperature and high pressure combustion gases from the combustion chamber. The engine comprises a body (23) inside which is a movable member (25) defining a variable volume chamber (29). The body (23) comprises an admission duct (35) and an exhaust duct (34). This engine comprises further an air preheating chamber (41) the inlet and outlet of which communicate, through a distribution member (36), alternately with the variable volume chamber (29). This engine comprises further a combustion chamber (44), provided with a fuel distributor, the inlet and outlet of which communicate, through the distribution member (36), alternately with the variable volume chamber (29).

27 Claims, 15 Drawing Figures

METHOD FOR THE TRANSFORMATION OF THERMAL ENERGY INTO MECHANICAL ENERGY BY MEANS OF A COMBUSTION ENGINE AS WELL AS THIS NEW ENGINE

There are numerous types of internal or external combustion and/or explosion engines which may be classified into two main categories, the two strokes engines and the four strokes engines.

The two strokes engines have the advantage of a high active strokes over inactive strokes ratio, equal to $\frac{1}{2}$, but on the other hand, due to their design the consumption of fuel is higher than in a four strokes engine.

The four strokes engines are more economical in fuel but have a relatively complicated distribution system and above all have an unfavorable active strokes over inactive strokes ratio of $\frac{1}{4}$. The heat losses through the walls are higher than in a two strokes engine.

The present invention has for its object an engine the cycle of which differs from the existing combustion engines which enables increasing the ratio between the active and inactive strokes with respect to the four strokes engines and to be more economical in fuel. It enables using all fuels and the real thermal efficiency is higher than in the known two and four strokes engines. The losses through the exhaust gases and cooling water are less.

In the Diesel engines a high compression level is necessary for the ignition of the gas-oil/air mixture. Furthermore the nearly instantaneous inflammation of the mixture causes knocking and noise phenomena. This type of engine necessitates a particularly resistant construction which is more onerous than a gasoline engine. The present invention enables using gas-oil while obviating to these drawbacks.

The realisation of the engine according to the invention is made possible by a new method and apparatus transformation of thermal energy into mechanical energy.

The attached drawings show schematically and by way of example three embodiments of the engine according to the invention.

Figure 1:
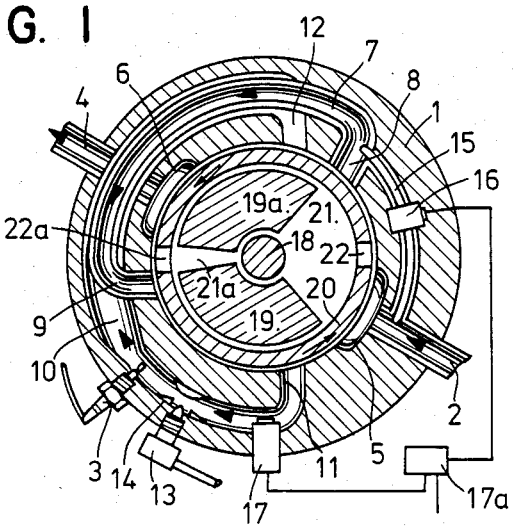
FIGS. 1 to 6 are schematic transverse cross-sections of a six strokes rotative engine showing the relative positions of the movable and fixed parts of the engine at the end of each of the six strokes constituting a complete working cycle.
Figure 2:
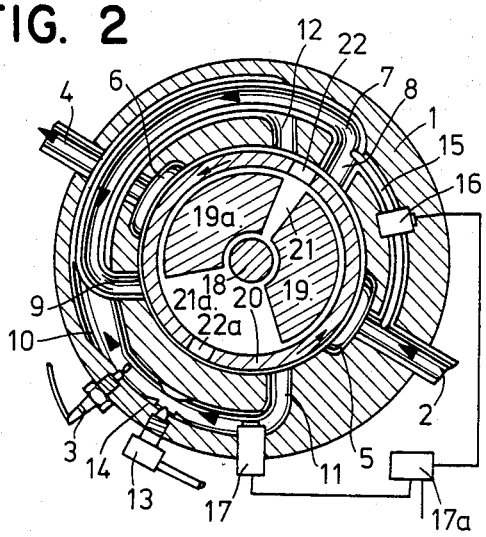
Figure 3:
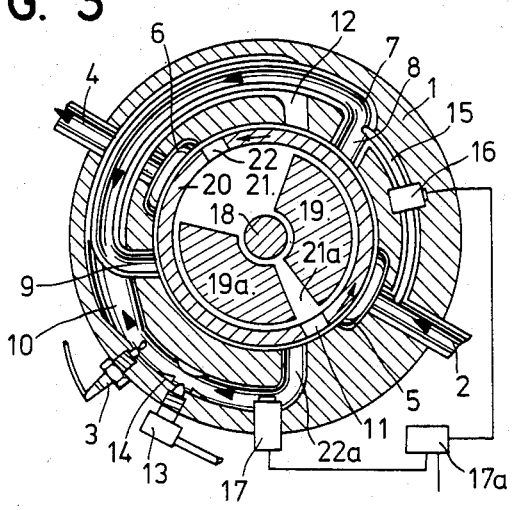
Figure 4:
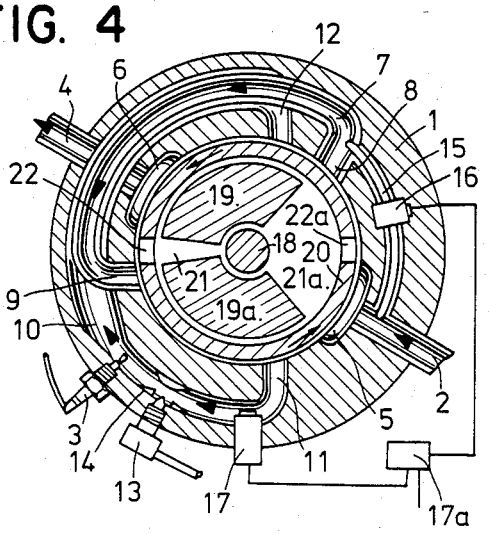
Figure 5:
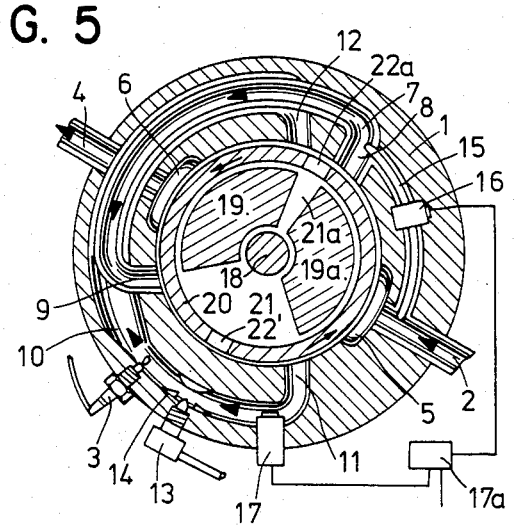
Figure 6:
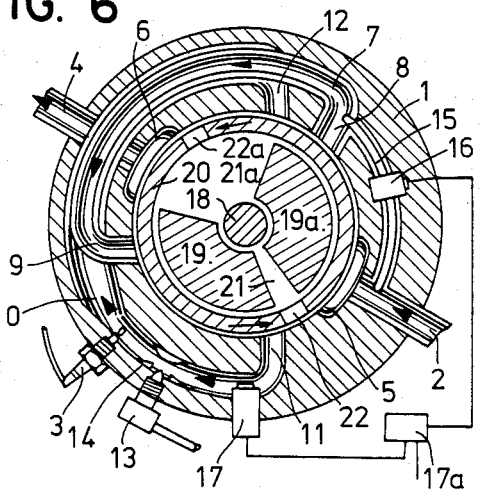

The present method for transforming thermal energy into mechanical energy makes use of a combustion engine comprising a body provided with an admission duct and an exhaust duct and having at least one movable member displaceable with respect to said body and defining a variable volume chamber.

This method comprises a working cycle the number of active and inactive strokes of which is higher than four and preferably equal to six.

Among the strokes of this cycle comprising more than six strokes, one finds always at least the four following strokes:

a. the compression of air contained in the variable volume chamber, through a reduction of the volume of said chamber, into a preheating chamber;

b. the expansion of the variable volume chamber through the expansion of hot air contained in the said preheating chamber.

c. the compression, through a reduction of volume of the variable volume chamber, of the hot expanded air located therein into a combustion chamber in which fuel is introduced causing the combustion of the thus obtained mixture;

d. the expansion of the variable volume chamber through the expansion in said chamber of high temperature and high pressure combustion gases coming from the combustion chamber.

In the case of a six stroke working cycle, the method comprises further the two following strokes:

e. the introduction of air, through the admission duct, into the variable volume chamber during an increase of volume of said chamber; and f. the expulsion, through the exhaust duct, due to a reduction of the volume of the variable volume chamber of the expanded combustion gas contained in said chamber.

This method comprises thus two active or motor strokes which are the expansion of the variable volume chamber by hot pressurized air (stroke b) and the expansion of said variable volume chamber by a high temperature and high pressure combustion gas (stroke d).

This method comprises thus a ratio between the active and inactive strokes equal to $\frac{1}{3}$ and an exhaust every six strokes only.

The method described comprises two_variants according to the succession of the strokes a to f in a complete working cycle. In a first variant the strokes of a cycle follow each other in the following manner: e, a, b, c, d, f whereas in the second variant thus succession of strokes is: e, a, d, f, b, c.

According to this method the air compressed into the preheating chamber during stroke "a" is heated by an exchange of heat between the combustion chamber and the preheating chamber.

In the second variant of the method it is to be noted that the air and the combustion gas remain in the preheating chamber, respectively the combustion chamber, during a time interval corresponding approximately to the duration of two successive strokes of the method. This is advantageous since, on the one hand the combustion can take place more slowly to limit the explosion phenomena and on the other hand this combustion can be more complete. Therefore the emission of toxic gases and of fumes is less. The combustion taking place in a chamber which is independent from the variable volume chamber, the violent shocks on movable members of the engine are eliminated, violent shocks which are an important drawback of the Diesel system. The construction is therefore lighter and the operation quieter.

Furthermore, in this second variant the time during which the air remains in the preheating chamber being longer, its temperature and its pressure are increased which results in a better efficiency.

According to this method one avoids every undesired overpressure in the combustion chamber by controlling the pressure of the preheating chamber as a function of that inside the combustion chamber. When the pressure increases above a given value in the combustion chamber, one causes the evacuation of a part of the air contained in the preheating chamber towards the admission duct.

To obtain an optimum preheating of the air contained in the preheating chamber, this chamber is located at least partly inside the combustion chamber. The air circulation occurs in only one direction in the said preheating chamber, said chamber having an inlet and an outlet.

The introduction, respectively the expulsion in and out of the variable volume chamber of the fresh air, of the hot air and of the combustion gases is obtained as seen hereinafter by means of a port distribution system or by means of actuated valves.

The first embodiment of the engine shown schematically in FIGS. 1 to 6, works according to the second variant of the method described, that is, the succession of strokes of a complete cycle is: e, a, d, f, b, c.

This engine comprises a stationary body 1 comprising an admission duct for ambient air 2. This body 1 comprises further an exhaust duct 4. This body has the general shape of a circular ring, the ducts 2 and 4 opening simultaneously on its outside and its inside peripheries. The admission 5 and exhaust 6 ports open on the inside periphery of the fixed ring 1 and are located in front one of another, i.e. displaced by about 180°.

The body or fixed ring 1 comprises a preheating chamber 7 having an inlet port 8 opening on the inside periphery of the body 1, between the admission port 5 and the exhaust port 6, about 60° after the admission port counterclockwise. The outlet port 9 of this preheating chamber 7 opens on the inside periphery of the body 1, about 60° after the exhaust port, again counterclockwise.

This body 1 comprises further a combustion chamber 10 the inlet port 11 of which is located between the admission port 5 and the outlet port 9 of the preheating chamber 7. The outlet port 12 of the combustion chamber 10 opens on the inside periphery of the body 1 between the inlet port 8 of the preheating chamber 7 and the exhaust port 6.

A fuel injector 13 opens in a constricted area 14 of said combustion chamber and enables delivering fuel in said chamber either by means of an injection pump, or by Venturi effect due to the circulation of the air in said chamber.

A spark plug 3 opens also into said combustion chamber 10 for igniting the gaseous mixture for a cold starting of the engine.

A passage 15 connects the inlet of the preheating chamber 7 to the admission port 5. A controlled valve 16 normally closes this passage 15. This valve is controlled by the pressure inside the combustion chamber 10, detected by means of a detector 17 and an electronic control device 17*a*.

The movable part of the engine comprises a motor shaft 18 connected to two pistons 19, 19*a* oscillating inside a distribution ring 20 rotatively mounted inside the body 1. This movable part of the engine is for example constructed in the manner described in FIGS. 1 to 6 of my copending application Ser. No. 403,130, filed July 29, 1982 and is arranged so that the pistons 19, 19*a* make three reciprocative movements, that is six alternate movements, during one revolution of the motor shaft 18 and of the distribution ring 20.

These oscillating pistons 19, 19*a* define two variable volume chambers 21, 21*a* working in opposition.

The distribution ring 20 has two opposed through openings 22, 22*a*, located in a middle plane of the chambers 21, 21*a* and continuously communicating with said chambers. These two openings are also located in a plane transverse to the motor shaft 18.

The operation of the engine described is the following:

1. During the rotation of the movable part of the engine from its position shown in FIG. 6 to its position shown in FIG. 1, the opening 22 of the distribution ring 20 has been displaced in front of the admission port 5 and the chamber 21 has passed from its minimum volume to its maximum volume sucking the atmospheric air through the admission duct. This corresponds to stroke "e" admission of air.
2. During a subsequent rotation of the movable part of the engine from its position shown in FIG. 1 to its position shown in FIG. 2, the chamber 21 reduces its volume causing a compression of the air confined in said chamber and the transfer of said compressed air into the preheating chamber 7 during the time when the opening 22 is in register with the inlet port 8 of said preheating chamber 7. This corresponds to stroke "a" of compression of the air. Before this transfer into the preheating chamber 7 said preheating chamber has emptied itself through the opening 22*a* into the chamber 21*a* causing its expansion (stroke b).
3. During the rotation of the movable part of the engine from its position shown in FIG. 2 to its position shown in FIG. 3, the opening 22 of the distribution ring 20 passes in front of the outlet port 12 of the combustion chamber 10 and the high temperature and high pressure combustion gas enters the chamber 21 and causes its expansion and therethrough the rotation of the motor shaft 18. This corresponds to stroke "d" expansion of the variable volume chamber under the action of the combustion gas.
4. During the rotation of the movable part of the engine from its position shown in FIG. 3 to the one shown in FIG. 4, the expanded combustion gases are expelled through a reduction of volume of the chamber 21 in the exhaust duct 4 through the opening 22 which is in front of the exhaust port 6. This corresponds to stroke "f", exhaust.
5. During the rotation of the movable part of the engine from its position shown in FIG. 4 to the one shown in FIG. 5, the opening 22 of the distribution ring 20 passes before the outlet slot of the preheating chamber 7 and the compressed air contained in said chamber, heated by heat exchange with the combustion chamber 10, enters the variable volume chamber 21, expands in said chamber causing its expansion. This corresponds to stroke "b", expansion of the preheated air.
6. During the rotation of the movable part of the engine from its position shown in FIG. 5 to the one shown in FIG. 6, the variable volume chamber compresses the expanded hot air, then sends it into the combustion chamber when the opening 22 of the distribution ring 20 passes before the inlet port 11 of the combustion chamber 10. This compressed hot air entering the combustion chamber 10 receives an adequate charge of fuel from the injector 13. The pressure and the temperature in said combustion chamber cause the auto-ignition of the mixture and its combustion. This corresponds to stroke "c", combustion. To start the engine when it is cold, the ignition is obtained by the spark plug 3. Before the transfer of this hot air into the combustion chamber 10, the opening 22*a* has passed before the outlet port 12 of the combustion chamber 10 the gas at high pressure of which has caused the expansion of the chamber 21*a* (stroke d).

The cycle starts again and repeats. In the engine schematically shown, the pistons 19, 19*a* define two variable volume chambers 21, 21*a* working in opposition, but effecting each for itself the succession of the precited operations 1 to 6, displaced by about 180°.

It is to be noted that during the expansion strokes b and d, the preheating chambers respectively the combustion chambers can be only partially emptied so as to maintain a given pressure in said chambers. These chambers can thus have a volume greater than the difference between the maximum and minimum volumes of the variable volume chamber. This increases the heat exchange between the combustion gases and the compressed air and ensures a better working regularity at any working speed.

The engine combines simplicity performance, economy and reduction of pollution. It is in fact to be seen that for each cycle of six strokes, two strokes are motor ones, the expansion of the preheated air and the expansion of the combustion gases; this increases thus the performance of such an engine over the four stroke cycle engine.

The hot compressed air sent into the combustion chamber remains in said chamber during $\frac{1}{3}$ of the working cycle, that is longer than is the case in a four strokes engine. One obtains thus a better combustion of the gas and a reduction of the emission of noxious gases and smoke.

Furthermore when the pressure rises above the desired pressure in the combustion chamber, part of the air contained in the preheating chamber is transferred to the admission port, preheating the fresh incoming air.

This engine can work with any fuel, petrol, gas-oil and so on. In fact, the temperature of the combustion chamber can be maintained at a high value during the whole working cycle. One can even provide elements inside said chamber remaining incandescent to enable the auto-ignition of the fuel.

Due to the fact that the combustion is slower than in a four stroke engine and that further the combustion chamber is in a monolithic block of the engine and finally that the pressure in said chamber is controlled, the construction of such an engine fed with gas-oil can be as light as that of a four stroke petrol engine.

Due to the fact that the pressure in the combustion chamber is limited, or even controlled for example as a function of the power demand and thus of the quantity of fuel which is introduced therein, the volume of the combustion gases contained in said chamber can be regulated so that after expansion in the variable volume chamber, these expanded combustion gases are at a pressure only slightly higher than the atmospheric pressure. Therefore, the exhaust noise of such an engine is greatly reduced.

The thermal efficiency of the engine can also be increased due to the fact that one can work at high temperature in the combustion chamber without being obliged to notably cool it. In fact, this chamber can be ceramic lined, as well as the ports and openings 22 to enable high temperature operation. Seals are provided between the moving members.

The power of the engine as well as consequently its number of turns is controlled by means of the quantity of fuel introduced into the combustion chamber, the intake of fresh air being practically constant.

The second embodiment of the engine shown in FIGS. 7 to 13 comprises a body 23 having at least one cylinder 24 in which a piston 25 reciprocates linearly. This piston 25 is connected to the crank 26 of a crankshaft 27 through a crank lever 28. The crankshaft 27 constitutes the motor shaft. The piston 25 defines with the cylinder 24 a variable volume chamber 29.

A rotor 30 is rotatively mounted in the upper part of the body 23 and is fastened to a shaft 31 carrying at one of its ends a toothed wheel 32. This toothed wheel 32 is connected to a pinion 33 fastened to the motor shaft. A ratio of $\frac{1}{3}$ of the kinematic linkage ensures that the rotor 30 revolves three times slower than the crankshaft 27.

The upper part of the body comprises an admission duct 35 and an exhaust duct 34 opening on the one hand on the outside lateral wall of the body 23 and on the other hand on the lateral wall of the housing of the body in which the rotor 30 is mounted.

A distribution member is constituted here by an opening 36 provided in the body 23 and connecting the variable volume chamber 29 to the periphery of the housing receiving the rotor 30. The body 23 houses further an ignition member, such as a spark plug 37 opening in a cavity 38 in the housing receiving the rotor 30. The spark plug 37 is displaced by about 60° clockwise with respect to the opening 36. The body 23 comprises further a fuel injector 39 opening in a cavity 40 that opens onto the periphery of the housing in which the rotor 30 is mounted.

The rotor 30 contains a preheating chamber 41 formed by a diametral channel the two ends of which, the inlet 42 and the outlet 43, open on the periphery of the rotor 30.

This rotor 30 houses further a combustion chamber 44, surrounding at least partially the preheating chamber 41, the inlet 45 and the outlet 46 of which open on the periphery of the rotor 30.

This rotor comprises further an admission passage 47 one end of which opens on the periphery of the rotor and the other end of which opens on the lateral face of the rotor and cooperates with the admission duct 35 of the body 23. Finally the rotor comprises an exhaust passage 48 one end of which opens on the periphery of the rotor 30, whereas the other end thereof opens on the lateral face of the rotor and cooperates with the exhaust duct 34 of the body.

All the openings opening on the periphery of the rotor 30 are adapted to cooperate successively, during the rotation of the rotor, with the distribution opening 36.

This engine works also according to the method previously described and comprises the six strokes a to f in the succession: e, a, d, f, b, c as for the first embodiment of the engine shown in FIGS. 1 to 6.

The operation of the second embodiment of the engine is the following:

1. While the piston 25 descends, the chamber 29 increases its volume, and the rotor passes from its position shown in FIG. 12 to that shown in FIG. 7, whilst the admission passage 47 connects the distribution aperture 36 to the admission duct 35 of the body 23 enabling a filling of the chamber 29 with fresh atmospheric air. This corresponds to stroke "e" of air admission. While the rotor 30 is in its position shown in FIG. 7, end of admission, the outlet 46 of the combustion chamber coincides with the housing 38. Thus if the combustible mixture contained in said chamber does not ignite by auto-ignition, it is possible to ignite it by means of a spark.

2. During the ascension of the piston 25, reducing the volume of the chamber 29, the rotor passes from its position shown in FIG. 7 to the one shown in FIG. 8, the air contained in the chamber 29 is compressed and then fed into the preheating chamber 41 when its inlet 42 coincides with the distribution aperture 36. This corresponds to stroke "a", compression of the air.
3. While the rotor 30 passes from its position shown in FIG. 8 to the one shown in FIG. 9, the outlet 46 of the combustion chamber passes in front of the distribution aperture 36 enabling the expansion of the combustion gas into the chamber 29 and urging the piston 25 downwards. This corresponds to stroke "d" expansion of the variable volume chamber under the action of the combustion gases.
4. During the subsequent ascension of the piston 25, reducing the volume of the chamber 29, the rotor passes from its position shown in FIG. 9 to the one shown in FIG. 10, the variable volume chamber 29 is connected through the aperture 36 and the passage 48 to the exhaust duct 34. This corresponds to stroke "f", exhaust. While the rotor 30 is in the position shown in FIG. 10, corresponding to the end of the exhaust, the injector 30 introduces a determined quantity of fuel into the combustion chamber the inlet 45 of which coincides with the housing 40.
5. While the rotor 30 passes from its position shown in FIG. 10 to the one shown in FIG. 11, the outlet 43 of the preheating chamber 41 passes in front of the aperture 36 and the preheated compressed air contained therein expands in the chamber 29 causing the descent of the piston 25. This corresponds to stroke "b" expansion of the preheated air.
6. During the subsequent upward movement of the piston 25, reducing the volume of the chamber 29, the rotor has passed from its position shown in FIG. 11 to the one shown in FIG. 12, and while the inlet 45 of the combustion chamber 44 passes in front of the opening 36, the hot expanded air contained in the variable volume chamber 29 is compressed into the combustion chamber 44. This hot compressed air entering into the combustion chamber receives an adequate charge of fuel from the injector 39. The pressure and the temperature in said combustion chamber cause the auto-ignition of the mixture and its combustion. This corresponds to stroke "c", combustion. The injection and ignition times will be determined in order to give optimal efficiency conditions during the time interval when the hot compressed air remains in the combustion chamber.

The advantages of this engine are the same as those of the first embodiment of the engine.

Figure 14:
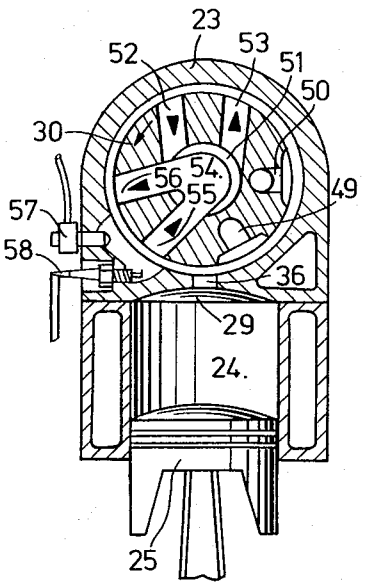
FIG. 14 is a partial transverse cross-section of a variant of the engine shown in FIGS. 7 to 12.
Figure 9:
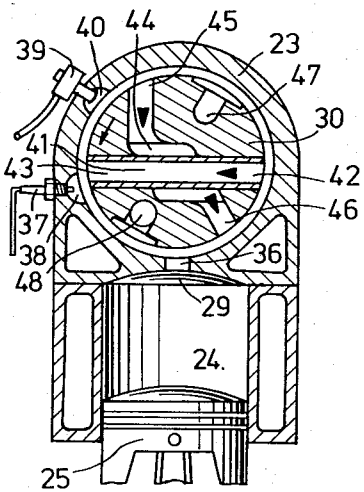
FIGS. 7 to 12 show in schematic transverse cross-section the six strokes of an embodiment of the engine with linearly reciprocable pistons.
Figure 12:
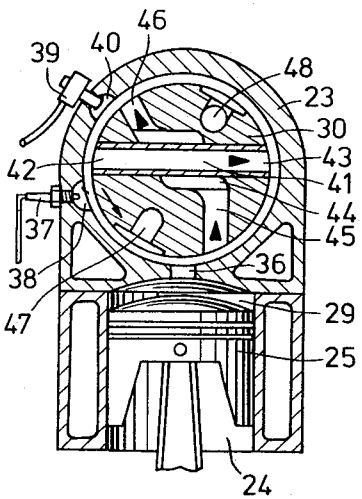
Figure 8:
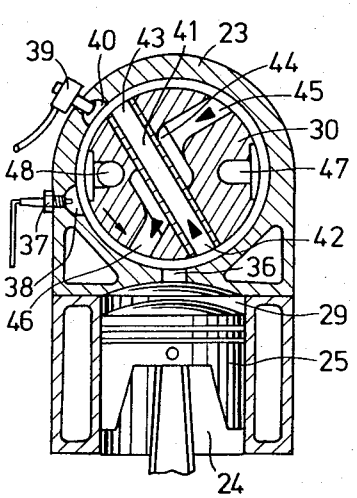
Figure 11:
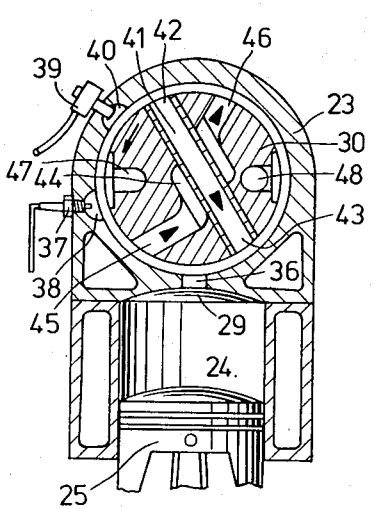
Figure 7:
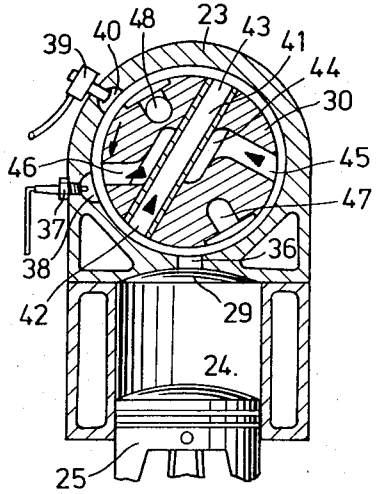
Figure 10:
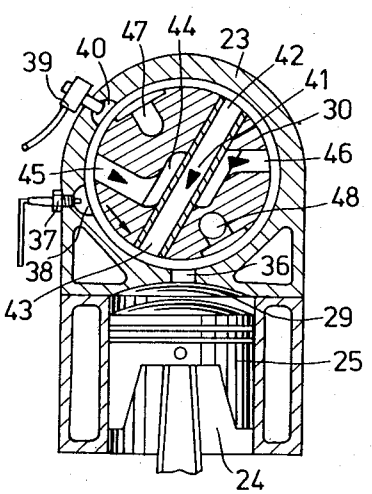

The variant shown in FIG. 14 refers to an engine of the type of the one described with reference to FIGS. 7 to 13, but wherein the succession of the strokes in a cycle is: e, a, b, c, d, f.

The rotor 30 of this modified engine comprises an admission passage 49 and an exhaust passage 50, the outlets of which opening on the periphery of the rotor are adjacent. A combustion chamber 51 is provided, the inlet 52, and the outler 53 of which are adjacent and a preheating chamber 54 is also provided the inlet 55, and the outlet 56 of which are also adjacent. This engine comprises also a fuel injector 57 and an ignition device 58.

In this embodiment, the rotor is also driven in rotation by the motor shaft at a speed three times less than said shaft.

Figure 15:
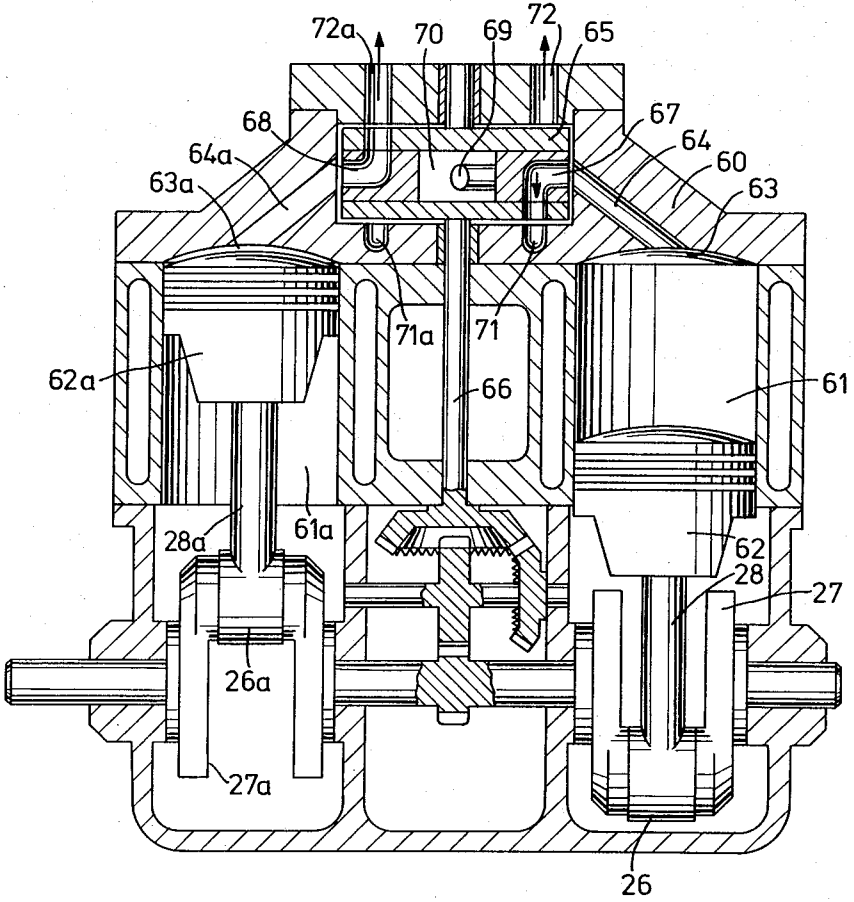
FIG. 15 shows in longitudinal cross-section a third embodiment of the engine.
Figure 13:
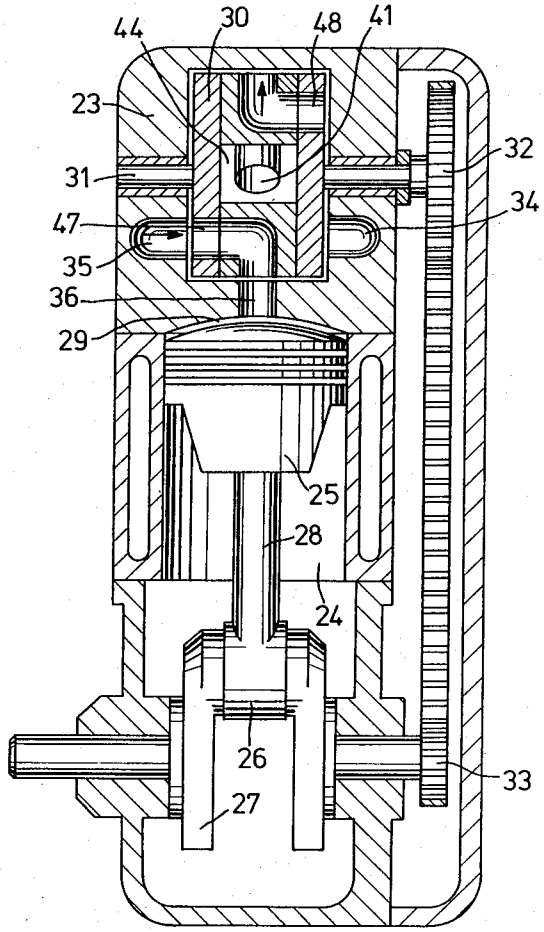
FIG. 13 is a longitudinal cross-section of the engine shown in FIGS. 7 to 12.

FIG. 15 shows a third embodiment of the engine comprising, as in the first embodiment, two variable volume chambers mounted in opposition but comprising, as in the second embodiment, pistons having a linear displacement and a rotor containing the preheating and combustion chambers.

This engine shown in FIG. 15 comprises a body 60 comprising two cylinders 61, **61*a* having parallel axes in which two pistons 62, 62*a* move which are connected through a conventional crank lever to a motor shaft. These two pistons work in opposition and define with the body two variable volume chambers 63, 63*a***.

Each of said chambers 63, **63*a* is connected to a housing provided in the body 60 by means of a distribution channel 64, 64*a* and the apertures of these channels opening in said housing cooperate with the apertures of a rotor 65 rotatively mounted in said housing. This rotor 65 is driven in rotation by a shaft 66** connected through gears to the motor shaft. This rotor revolves three times slower than the motor shaft.

The rotor 65 comprises an admission passage 67, an exhaust passage 68, a preheating chamber 69 and a combustion chamber 70 as in the second embodiment of the engine.

The body 60 comprises admission ducts 71, **71*a* and exhaust ducts 72, 72*a***, as well as an injector for fuel (not shown) and possibly an ignition device (not shown).

The operation of this engine is identical to that of the second embodiment but for the fact that only one rotor feeds two variable volume chambers working in opposition. For each cylinder 61, **61*a* one has exactly the six working strokes 1 to 6 of the second embodiment of the engine, each passage or chamber of the rotor 65 coacting alternately with the distribution channel 64, 64*a* of one and the other variable volume chambers 63, 63*a***.

This third embodiment can be especially advantageous, since it could be applied to conventional engine blocks by simply modifying their cylinder head.

A further advantage of the engines shown in FIGS. 1 to 12 and 13 and 15 is that the inlets and outlets of the preheating chamber and of the combustion chamber being opposed or at least displaced by approximately 180°, the pressures exerted on the rotor are balanced.

What I claim is:

1. Method for the transformation of thermal energy into mechanical energy by means of a combustion engine comprising a body provided with admission and exhaust ducts, as well as at least one member movable within said body defining at least one chamber having a variable volume, comprising establishing a cycle of more than four strokes, at least four of these strokes comprising:

a. compressing air contained in the variable volume chamber, through a reduction of the volume of said chamber, into a preheating chamber;
b. expanding the variable volume chamber through the expansion of the hot air contained in the preheating chamber;
c. compressing, through a reduction of the volume of the variable volume chamber, the hot expanded air in said variable volume chamber, into a combustion chamber in which fuel is introduced and causing the combustion of the mixture thus obtained; and d. expanding the variable volume chamber through the expansion into said chamber of the combustion gases at high temperature and high pressure from the combustion chamber.

2. A method according to claim 1, in which the complete cycle comprises six strokes, the two additional strokes being:

e. the introduction of air, through the admission duct, into the variable volume chamber during an increase of volume of said chamber; and f. the expulsion, through the exhaust duct, by means of a reduction of volume of the variable volume chamber, of the expanded combustion gases contained in said chamber.

3. A method according to claim 2, in which the complete cycle comprises two active strokes (b, d) and four inactive strokes (a, c, e, f).

4. A method according to claim 3, in which the succession of the strokes in a complete cycle is: e, a, b, c, d, f.

5. A method according to claim 3, in which the succession of the strokes in a complete cycle is: e, a, d, f, b, c.

6. A method according to claim 1, and heating the compressed air contained in the preheating chamber by heat exchange with the combustion gas contained in the combustion chamber.

7. A method according to claim 1, and limiting the pressure in the preheating chamber to a given value.

8. A method according to claim 7, in which when the pressure in the preheating chamber rises over a limit value a part of the air contained therein is discharged into the admission duct.

9. A method as claimed in claim 7, in which the given value of the pressure in the preheating chamber is controlled as a function of the pressure existing in the combustion chamber.

10. A method according to claim 1, in which the air contained in the preheating chamber circulates in the opposite direction to the combustion gas contained in the combustion chamber.

11. A method according to claim 1, in which the circulation of the fluids inside the preheating and combustion chambers is unidirectional.

12. Combustion engine comprising a body, at least one movable member defining in said body at least one chamber, the volume of which varies as a function of the relative position of this movable member with respect to the body; the body having an admission duct and an exhaust duct, a preheating chamber for air the inlet and the outlet of which are adapted to communicate by means of a distribution member alternately with the variable volume chamber, and a combustion chamber having a fuel distributor, the inlet and the outlet of said combustion chamber being adapted to communicate through said distribution member alternately with said variable volume chamber.

13. An engine according to claim 12, in which the preheating chamber and the combustion chamber constitute a heat exchanger.

14. An engine according to claim 12, in which the distribution member places the variable volume chamber alternately in communication with the admission and exhaust ducts.

15. An engine according to claim 14, which comprises a passage connecting the preheating chamber to the admission duct, in which passage a pressure regulating element is mounted to control the pressure inside the preheating chamber.

16. An engine according to claim 15, in which said pressure regulating element is controlled as a function of the pressure inside the combustion chamber.

17. An engine according to claim 12, in which the variable volume chamber rotates with respect to the body.

18. An engine according to claim 17, in which the preheating and combustion chambers are located in the body of the engine; the distribution member is a ring provided with at least one aperture in permanent communication with the variable volume chamber; and the movable member is at least one piston connected to the distributing ring and to a motor shaft.

19. An engine as claimed in claim 17, in which the movable member is a piston linearly reciprocating with respect to the body; the distribution member is an aperture, provided in the body and in permanent communcation with the variable volume chamber; and the preheating and combustion chamber are located in a rotor rotatively mounted in the body.

20. An engine according to claim 19, in which the rotor and the motor shaft are connected by a linkage such that the motor shaft revolves three times faster than the rotor.

21. An engine according to claim 19, in which the rotor comprises further admission and exhaust ducts one end of which cooperates with the aperture whereas the other end opens onto the lateral faces of the rotor and cooperates with the admission and exhaust ducts of the body.

22. An engine according to claim 21, in which the axis of rotation of the rotor is parallel to the motor shaft.

23. An engine according to claim 21, in which the axis of rotation of the rotor is perpendicular to the motor shaft.

24. An engine according to claim 21, in which one rotor cooperates with two variable volume chambers.

25. An engine according to claim 12, in which the volume of the preheating chamber and of the combustion chamber is greater than the difference between the maximum and minimum volumes of the variable volume chamber.

26. An engine according to claim 12, in which the inlet and the outlet of each of the preheating and combustion chambers are displaced by approximately 180° from each other.

27. An engine according to claim 12, in which the volume of one of the preheating chamber and the combustion chamber is greater than the difference between the maximum and minimum volumes of the variable volume chamber.

* * * * *